US007174641B2

(12) United States Patent
Kondo et al.

(10) Patent No.: US 7,174,641 B2
(45) Date of Patent: Feb. 13, 2007

(54) CUTTING TOOL

(75) Inventors: Masaki Kondo, Anjo (JP); Toshiyuki Kani, Anjo (JP)

(73) Assignee: Makita Corporation, Anjo (JP)

( * ) Notice: Subject to any disclaimer, the term of this patent is extended or adjusted under 35 U.S.C. 154(b) by 229 days.

(21) Appl. No.: 10/734,056

(22) Filed: Dec. 10, 2003

(65) Prior Publication Data

US 2004/0168327 A1 Sep. 2, 2004

(30) Foreign Application Priority Data

Dec. 10, 2002 (JP) ..... 2002-358422
Dec. 10, 2002 (JP) ..... 2002-358546

(51) Int. Cl.
*B27B 9/04* (2006.01)

(52) U.S. Cl. ..... 30/371; 30/374

(58) Field of Classification Search ..... 83/574, 83/743, 745; 33/32.1, 32.2, 42, 630, 631; D8/66–70; 30/371–378
See application file for complete search history.

(56) References Cited

U.S. PATENT DOCUMENTS

| | | | | |
|---|---|---|---|---|
| 1,806,528 | A * | 5/1931 | Fegley et al. | 30/377 |
| 2,688,347 | A * | 9/1954 | Schmidt | 30/373 |
| 2,773,523 | A * | 12/1956 | Hopla | 83/745 |
| 2,790,468 | A * | 4/1957 | Wilhide | 30/391 |
| 3,043,351 | A * | 7/1962 | Davis | 30/373 |
| 5,815,931 | A * | 10/1998 | Cleveland | 30/373 |
| 6,708,411 | B2 * | 3/2004 | Kani | 30/376 |
| 2002/0000046 | A1 | 1/2002 | Hartmann | |

FOREIGN PATENT DOCUMENTS

| | | |
|---|---|---|
| GB | 2 302 058 A | 1/1997 |
| JP | 4-30902 | 3/1992 |
| JP | 08-103901 | 4/1996 |
| JP | 2001-269901 | 10/2001 |
| JP | 2001-287202 | 10/2001 |
| JP | 2001-315101 | 11/2001 |
| JP | 2002-283301 | 10/2002 |
| WO | WO-01/78929 A1 | 10/2001 |

* cited by examiner

*Primary Examiner*—Stephen Choi
(74) *Attorney, Agent, or Firm*—Lahive & Cockfied LLP; Anthony A. Laurentano, Esq.

(57) ABSTRACT

The present invention provides a technique for improving the workability of a cutting tool. According to the present invention, a cutting tool may comprise a body, a base, a sub-base and a parallel ruler. The body may have a blade that can be rotationally driven. The base may be connected to the body, while the base is placed in contact with the upper surface of the workpiece. The body may tilt in a pivotal movement about an axis substantially parallel to the cutting direction such that a cutting operation can be performed with the blade projecting laterally outward from a side of the base. The sub-base may be removably attached to the base on the side from which the blade projects. The parallel ruler may be removably attached to the base on the side on which the sub-base is attached or on the opposite side of the base, together with the sub-base or in the state in which the sub-base is not attached.

4 Claims, 8 Drawing Sheets

CUTTING TOOL

BACKGROUND OF THE INVENTION

1. Field of the Invention

The present invention relates to a cutting tool, such as a circular saw and a cutter, and more particularly, to a technique for improving the workability of the cutting tool when an auxiliary device, such as a parallel guide, is attached to the circular saw.

2. Description of the Related Art

Japanese laid-open patent publication No. 2001-315101 discloses a technique for improving the workability of a circular saw for edge-cutting operation. Specifically, a guide arm is provided that can project laterally outward from the base. The distance between the circular saw and the wall can be appropriately adjusted by changing the amount of projection of the guide arm. Thus, even when using a blade with different thickness, damage to the wall can be effectively prevented.

According to the known art, the distance between the circular saw and the wall can be adjusted by the guide arm for performing an edge-cutting operation. For this edge-cutting operation, the base is formed to have a shorter width on the blade projection side in order to provide enough space for allowing projection of the blade from the side of the base. Therefore, when the edge-cutting operation is not performed, a so-called sub-base can be removably attached to the base in order to make up for the shorter width of the base. Thus, not only the base having a shorter width but the sub-base can be placed in sliding contact with the workpiece, so that the cutting operation can be performed with stability. In addition to such construction, in which the circular saw can be placed on the workpiece in sliding contact with stability, for the circular saws that can perform edge-cutting operation as well, it is further desired to improve its workability by making additional provision for properly guiding the direction of cutting the workpiece with the blade.

Moreover, Japanese laid-open patent publication No. 2001-287202 discloses a portable circular saw in which the cutting start position of the blade is kept fixed even with a change of the tilting angle of the blade. With this technique, the cutting start position of the tilted blade is kept fixed, so that the usability of the circular saw in the edge cutting operation can be improved.

According to this known art, the circular saw has a blade and a driving motor for driving the blade. The blade projects laterally outward from the side of the base when the relatively large-sized body tilts. In an actual work area of edge cutting operation, however, the space for the cutting operation using a circular saw is often limited. It is therefore desired to provide a circular saw which dose not interfere with the cutting operation even in a limited working space.

SUMMARY OF THE INVENTION

It is, accordingly, an object of the present invention to provide a technique for improving the workability of a cutting tool.

According to the present invention, a cutting tool may comprise a body, a base, a sub-base and a parallel ruler. The body may have a blade that cuts a workpiece by moving forward in a predetermined cutting direction while being rotationally driven. The base may be connected to the body, while the base is placed in contact with the upper surface of the workpiece. The body may tilted in a pivotal movement about an axis which is substantially parallel to the cutting direction such that a cutting operation can be performed with the blade projecting laterally outward from a side of the base. According to the present invention, the sub-base may be removably attached to the base on the side from which the blade projects. The parallel ruler may be removably attached to the base on the side on which the sub-base is attached or on the opposite side of the base, together with the sub-base or in the state in which the sub-base is not attached.

Further, according to the other aspect of the present invention, a cutting tool comprising a body and a base may preferably be provided. Within this cutting tool, the base may be connected to the body and may be placed in contact with the upper surface of the workpiece. The body may be tilted in a pivotal movement about an axis that is substantially parallel to the cutting direction such that a cutting operation can be performed with the blade that laterally projects outward from a first base side plane that includes a first side surface of the base. The tilted body may be prevented from projecting laterally outward from a second base side plane including a second side surface of the base which is opposed to the first side surface.

According to the present invention, workability of a cutting tool can be improved. Other objects, features and advantages of the present invention will be readily understood after reading the following detailed description together with the accompanying drawings and the claims.

DETAILED DESCRIPTION OF THE INVENTION

Figure 1:
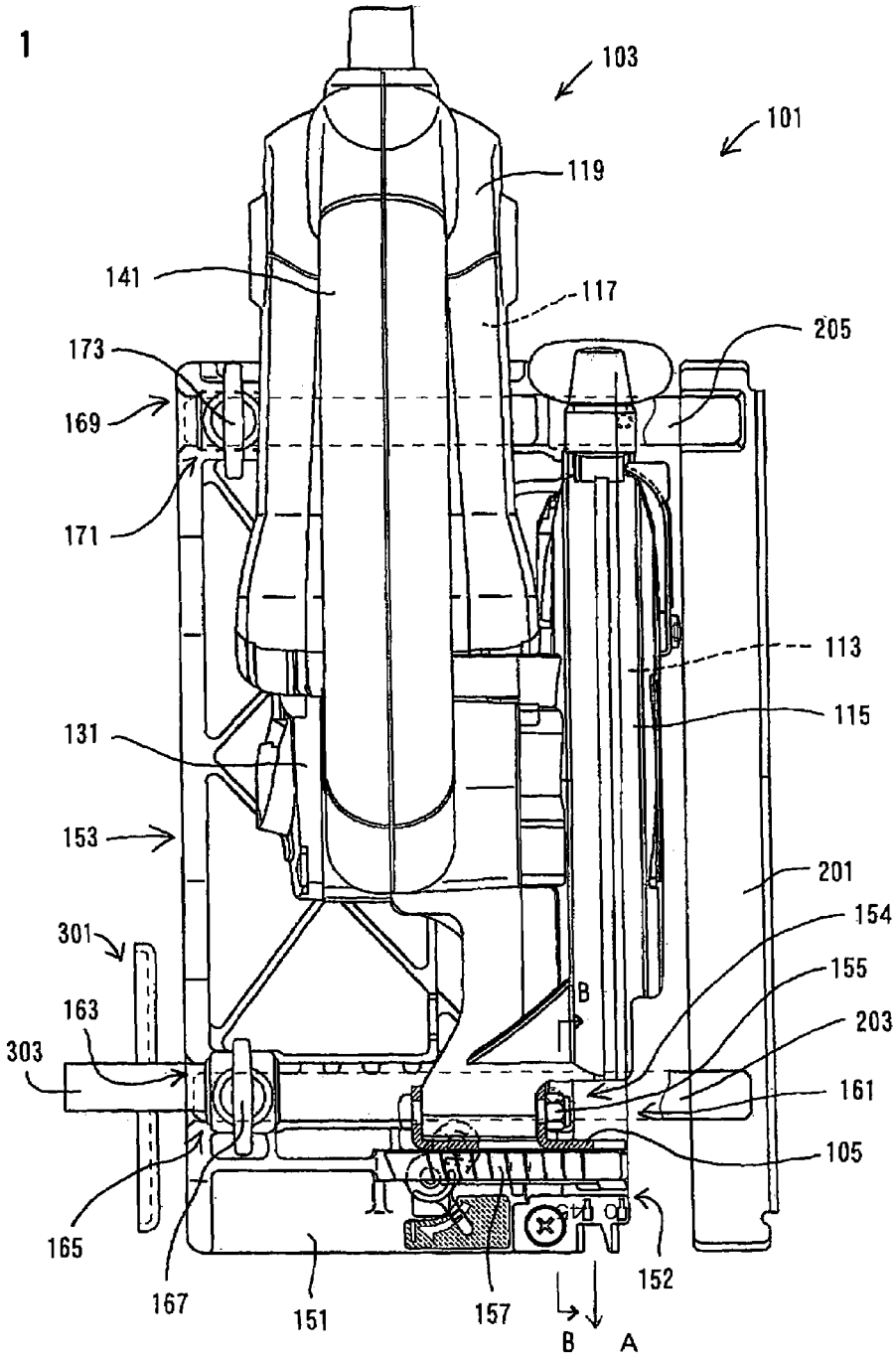
FIG. 1 is a plan view of a circular saw according to a representative embodiment of the invention.

According to the present invention, a representative cutting tool may include a body and a base. Typically, the "cutting tool" may embrace a potable circular saw for wood cutting, a portable cutter for stone or steel cutting, etc. The body may have a blade that cuts a workpiece by moving forward in a predetermined cutting direction while being rotationally driven. Further, the base is connected to the body and is placed during the operation in contact with the upper surface of the workpiece. Within the cutting tool according to the present invention, the body can tilt in a pivotal movement about an axis which is substantially parallel to the cutting direction, so that the cutting operation can be performed with the blade projecting laterally outward from the side of the base. In other words, a so-called edge cutting operation, for example, to cut a floor material near a wall can be performed.

Further, in the present invention, a sub-base is provided and can be removably attached to the base on the side from which the blade projects. In the construction in which the edge cutting operation can be performed with the blade that projects laterally outward from the side of the base, the width of the base is typically made shorter in order to avoid interference of the base with the wall during the edge cutting operation. Therefore, when such a circular saw is used for an ordinary cutting operation rather than edge cutting operation, the sub-base is used to make up for the short width of the base.

Further, according to the present invention, a parallel ruler can be removably attached to the base on the side on which the sub-base is to be attached or on the opposite side of the base, together with the sub-base or in the state in which the sub-base is not attached. The parallel ruler is defined as an auxiliary device for guiding the cutting tool in the cutting direction in sliding contact with the side surface of the workpiece when the cutting tool is moved in the direction of cutting the workpiece.

According to the present invention, in an ordinary cutting operation rather than edge cutting operation, the sub-base and/or the parallel ruler can be attached in various manners. For example, the sub-base is attached on one side and the parallel ruler is attached on the same side as the sub-base; the sub-base is attached on one side and the parallel ruler is attached on the opposite side; or the sub-base is attached and the parallel ruler is not attached. The manners of attachment may be appropriately selected according to the working conditions. Thus, the workability in the cutting operation can be improved.

Preferably, the sub-base may include a sliding contact surface and a guide. The sliding contact surface can be placed in surface contact (facial contact) with the upper surface of the workpiece and thus serves to make up for the base. Further, the guide extends vertically from the edge of the sliding contact surface. The guide is capable of guiding the cutting tool in the cutting direction in sliding contact with the side surface of the workpiece when the sub-base is attached upside down to the base. Therefore, the sub-base not only serves to make up for the base in an ordinary cutting operation rather than edge cutting operation, but functions as a parallel ruler when attached upside down. Thus, the components construction can be further rationalized.

Preferably, the base may have a sub-base clamping hole and a parallel ruler clamping hole. A clamping portion of the sub-base is removably inserted through the sub-base clamping hole. Thus, the sub-base is removably attached to the base. Further, the parallel ruler clamping hole is disposed on or under the sub-base clamping hole and a clamping portion of the parallel ruler is removably inserted through the parallel ruler clamping hole. Thus, the parallel ruler is removably attached to the base on or under the sub-base.

Further, in the present invention, the sub-base clamping hole and the parallel ruler clamping hole are arranged such that at least either a front or rear end of the upper one of the two clamping holes is positioned between the both ends of the lower clamping hole. If both of the front and rear ends of the upper clamping hole are not positioned between the both ends of the lower clamping hole, the lower clamping hole may be completely open to the upper clamping hole along the longitudinal direction of the base. In this case, if one of the sub-base and the parallel ruler is attached to the base through the lower clamping hole and the other is not attached through the upper clamping hole, the lower one may lift toward the upper clamping hole. Therefore, such construction is inconvenient in ensuring reliable attachment of the sub-base or parallel ruler. Specifically, for example, the parallel ruler may be clamped to the base near one side of the base through the above-mentioned clamping hole. When the parallel ruler extends laterally outward through the clamping hole open to the opposite side of the base and is placed in contact with the side surface of the workpiece so as to serve as a guide in the cutting direction, the tip of the parallel ruler is positioned at some distance from the clamping point. In such a case, if any measure is not taken, on the side of the base which is remote from the clamping point, to prevent the parallel ruler from lifting toward the upper claming hole, the parallel ruler in the lower clamping hole will lift toward the upper claming hole. As a result, the portion of the parallel ruler which must be in contact with the workpiece may lift obliquely to such a greater degree that it can no longer function as a parallel ruler. In this respect, according to the present invention, such lifting of an attachment in the clamping hole can be prevented, and thus workability deterioration caused by such lifting can be reliably prevented.

With the construction, in which at least either a front or rear end of the upper one of the sub-base clamping hole and the parallel ruler clamping hole is positioned between the both ends of the lower clamping hole, the end of the upper clamping hole presses against the sub-base or parallel ruler which is inserted through the lower clamping hole, thereby preventing the lower attachment from lifting. Thus, such construction ensures reliable attachment.

Further, in the above construction, the sub-base clamping hole may have substantially the same width in the longitudinal direction of the base as the parallel ruler clamping hole.

In this case, preferably, the clamping holes may be formed in a position displaced from each other in the longitudinal direction of the base. With this construction, either the front or rear end of the upper one of the two clamping holes can be always positioned between the both ends of the lower clamping hole. Thus, the end of the upper clamping hole presses against the sub-base or parallel ruler which is inserted through the lower clamping hole, thereby preventing the lower attachment from lifting.

Further, in the above construction, in order to mount both the sub-base and the parallel ruler, preferably, the sub-base and the parallel ruler may be inserted through the respective clamping holes and removably clamped to the base at the same time by one clamping device.

In this case, the sub-base and the parallel ruler can be clamped to the base at the same time by utilizing single clamping device. Thus, the number of components required can be reduced and the clamping operation can be rationalized, so that working efficiency in mounting the attachments can be improved.

Preferably, the base may have a front sub-base clamping hole and a rear sub-base clamping hole, through which holes respective clamping portions of the sub-base are removably inserted. Specifically, the sub-base can be clamped to the base at two points in the front and rear portions of the base. Preferably, the front and rear sub-base clamping holes may be formed in a vertically displaced position from each other. With this construction, the sub-base cannot be attached to the opposite side of the base, so that improper attachment of the sub-base can be prevented.

Further, as another example of the present invention, a representative cutting tool may include a body and a base that is connected to the body. In the present teachings, the body can be tilted in a pivotal movement about an axis which is substantially parallel to the cutting direction such that a cutting operation can be performed with the blade projecting laterally outward from a first base side plane that includes a first side surface of the base. By thus allowing the blade to perform a cutting operation with the blade projecting laterally outward from the first plane of the base, the base dose not interfere with the wall surface when the blade is set on a work area of a workpiece, such as a floor material near a wall.

Further, the tilted body may preferably be prevented from projecting laterally outward from a second base side plane including a second side surface of the base which is opposed to the first side surface. Therefore, even when the blade projects laterally outward from the side of the base in an edge cutting operation, the body does not project laterally outward from the base. Thus, the space can be advantageously saved in a width direction of the cutting cool.

Preferably, the body may include a driving motor that drives the blade. The axial direction of the output shaft of the driving motor is substantially perpendicular to the rotating shaft of the blade. Typically, the axial direction of the output shaft of the driving motor corresponds to the longitudinal direction of the driving motor. Therefore, the output shaft of the driving motor is disposed substantially perpendicular to the rotating shaft of the blade, so that the longitudinal direction of the driving motor is substantially parallel to the rotational face of the blade. Thus, the driving motor can be longitudinally disposed along the moving direction of the cutting tool or the longitudinal direction of the cutting tool.

Typically in known circular saws, the output shaft of the driving motor is provided to be parallel to the rotating shaft of the blade. In other words, the driving motor within the known art is disposed transversely or substantially perpendicularly to the moving direction of the circular saw. Compared with such known tools, the body of the present invention can be more readily prevented from projecting laterally outward from the side of the base when the body is tilted.

The axial direction of the output shaft of the motor may be arranged to be "substantially perpendicular to the rotating shaft of the blade" in a suitable manner either by directly engaging the output shaft of the motor with the rotating shaft of the blade at right angles or by arranging them to extend at right angles with respect to each other and indirectly connecting them via a power transmission mechanism.

Each of the additional features and method steps disclosed above and below may be utilized separately or in conjunction with other features and method steps to provide improved cutting tools and method for using such cutting tools and devices utilized therein. Representative examples of the present invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

A representative embodiment of the present invention will be explained with respect to a circular saw 101 as an example of cutting tools. As shown in FIG. 1, the circular saw 101 according to the representative embodiment may substantially include a body 103 and a base 151. Further, a sub-base 201 and a parallel ruler 301 are removably attached to the circular saw. The body 103 is a feature that corresponds to the "body of the cutting tool" according to the present invention.

The body 103 may comprise a blade case 115, a motor housing 119, a gear housing 131 and a handgrip 141. Blade case 115 houses a blade 113, motor housing 119 houses a driving motor 117, and gear housing 131 houses a mechanism for transmitting the rotating output of the driving motor 117 to the blade 113. Handgrip 141 is integrally formed on the upper portion of the motor housing 119. Although it is not particularly shown in drawings, a trigger switch for starting the driving motor 117 is provided on the handgrip 141.

Base 151 is formed of aluminum alloy in order to save the weight. The body 103 is connected to the base 151 in the front end region 154 of the base 151 such that the body 103 can pivot toward or away from the base 151 (in the vertical direction with respect to the base 151) and tilt in the lateral direction with respect to the base 151. Specifically, a connecting member 105 is connected to the body 103 via a bolt 155 and fixedly attached to an angle plate 157 that extends upward from the base 151. Therefore, the body 103 can pivot around the bolt 155 in the vertical direction with respect to the base 151. The cutting depth of a workpiece by the blade 113 is determined by the angle of such pivotal movement of the body 103. Further, the connecting member 105 is fixedly attached to the angle plate 157 in a locking point within a guide slit (not shown) of the angle plate 157. The locking point of the connecting member 105 can be adjusted in such a manner that the body 103 can be locked in a state of having tilted in the lateral direction (rightward and leftward as viewed in FIGS. 1 and 2) with respect to the base 151 by a predetermined amount. While being kept in such a tilted state, as mentioned above, the body 103 pivots around the bolt 155 in the vertical direction (in the longitudinal direction ) with respect to the base, so that the cutting depth can be adjusted.

Sub-base 201 extends along the longitudinal direction of the circular saw 101 and is disposed in parallel with the base 151 via a front pole 203 and a rear pole 205.

Similarly as the sub-base 201, the parallel ruler 201 extends along the longitudinal direction of the circular saw 101 and is disposed in parallel with the base 151 via a pole 303.

In the front end region 154 of the base 151, a front sub-base clamping hole 161 and a parallel ruler clamping hole 163 extend transversely through the base 151. A front clamping portion 165 is formed on the clamping holes 161, 163. The front pole 203 of the sub-base 201 can be inserted through the front sub-base clamping hole 161, while the pole 303 of the parallel ruler 301 can be inserted through the parallel ruler clamping hole 163. In the rear end region of the base 151, a rear sub-base clamping hole 169 is formed, and a rear clamping portion 171 is formed on the rear sub-base clamping hole 169. The rear pole 205 of the sub-base 201 can be inserted through the rear sub-base clamping hole 169.

The poles 203, 205 of the sub-base 201 and the pole 303 of the parallel ruler 301 through the clamping holes 161, 163 can be removably clamped to the base 151 via clamping screws 167, 173 of the clamping portions 165,171.

Figure 2:
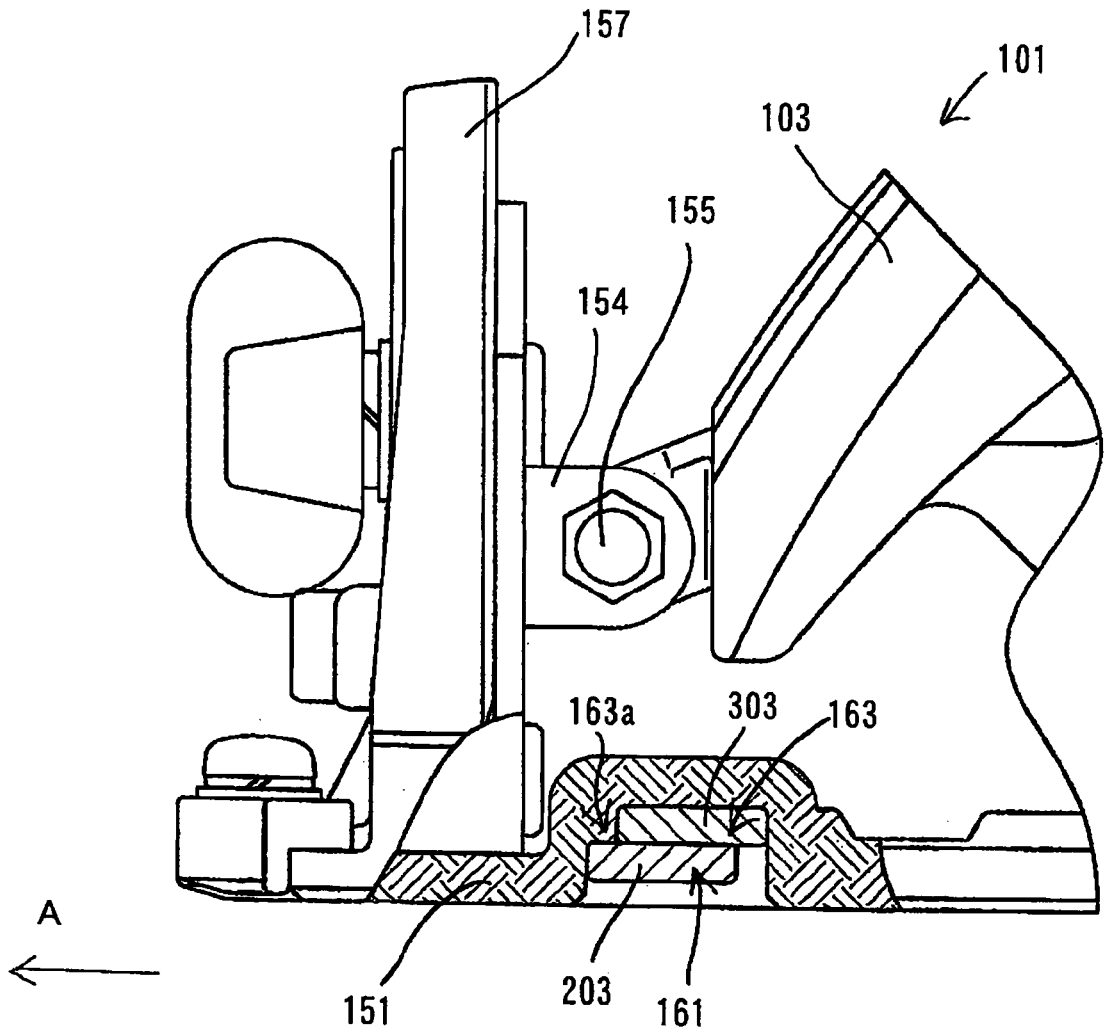
FIG. 2 is a side view, partially shown in section, of the circular saw according to the representative embodiment, showing the relationship between the sub-base clamping hole and the parallel ruler clamping hole.
Figure 3:
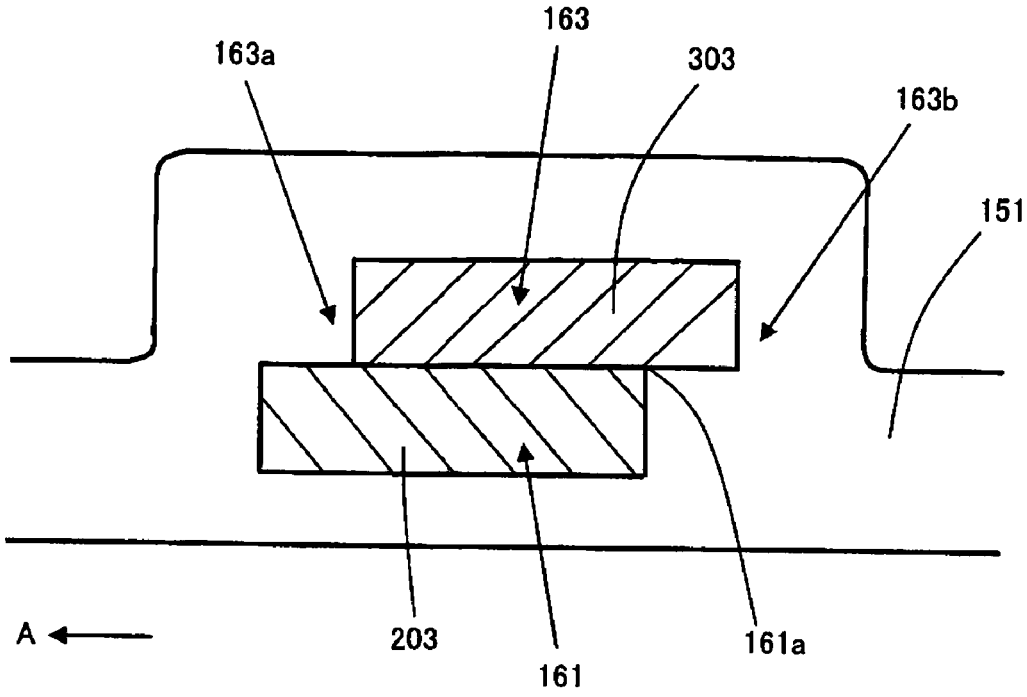
FIG. 3 is a side view schematically showing the relationship between the sub-base clamping hole and the parallel ruler clamping hole in the region of the opening.

The construction of the front sub-base clamping hole 161 and the parallel ruler clamping hole 163 is shown in detail in FIGS. 2 and 3. FIG. 2 shows the clamping holes 161, 163 in sectional view taken along line B—B in FIG. 1. FIG. 3 is a side view schematically showing the region of the opening of the clamping holes 161, 163. As shown in FIGS. 2 and 3, the parallel ruler clamping hole 163 is formed on the front sub-base clamping hole 161. Further, in this embodiment, one end 163*a* of the parallel ruler clamping hole 163 in the longitudinal direction A of the circular saw 101 is positioned between the both ends of the front sub-base clamping hole 161.

As shown in FIG. 3, one end 161*a* of the front sub-base clamping hole 161 in the longitudinal direction A of the circular saw 101 is positioned between the both ends 163*a*, 163*b* of the parallel ruler clamping hole 163 in the region of the opening.

With this construction, even when the parallel ruler 301 is not mounted on the front pole 203, the front pole 203 in the front sub-base clamping hole 161 is reliably prevented from lifting by the end 163*a* of the clamping hole 163 being in contact with the pole 203. Further, even when the sub-base 201 is not mounted under the pole 303 of the parallel ruler 301, the pole 303 in the parallel ruler clamping hole 163 is reliably prevented from dropping by the end 161*a* supporting the pole 303. In this embodiment, the front pole 203 has the same sectional shape as the pole 303 (and the rear pole 205). Therefore, when the sub-base 201 is not mounted under the pole 303, it is preferable to insert and lock the pole 303 of the parallel ruler 303 through the front sub-base clamping hole 161. Advantageously, in this manner, the pole 303 in the front sub-base clamping hole 161 can be brought in surface contact (facial contact) with the bottom surface of the front sub-base clamping hole 161, so that the parallel ruler 301 can be reliably mounted with stability. In addition, the end 163*a* of the clamping hole 163 is in contact with the pole 303 in the same manner as mentioned above, so that the pole 303 can be prevented from lifting.

Circular saw 101 of this embodiment is thus constructed. Operation of the circular saw 101 will now be explained. When an operator holds the handgrip 141 and operates the trigger switch, which is not shown, the driving motor 117 is driven. The torque of the driving motor 117 is transmitted to the rotating shaft that is integrally formed with the blade 113, via a power transmission mechanism disposed within the gear housing 131, so that the blade 113 is rotated.

In this state, when the operator pushes the handgrip 141 forward, the circular saw 101 cuts the workpiece while moving forward in its longitudinal direction A (see FIG. 1). The longitudinal direction A of the circular saw 101 corresponds to the direction of cutting a workpiece by the blade 113.

In an operation of cutting, for example, a flooring material along a wall edge (which is referred to as "edge cutting" in the following description), the body 103 is tilted in the lateral direction with respect to the base 151 by appropriately adjusting the locking position of the connecting member in the angle plate 157. The edge cutting mode is set in this manner. In FIG. 1, the edge cutting mode can be set by tilting the body 103 toward the right side 153 of the base 151 (to the left side as viewed in FIG. 1). In this state, the lower region of the blade 113 projects laterally outward (rightward as viewed in FIG. 1) from the left side 152 of the base 151. Thus, the cutting operation can be performed on a workpiece along the edge of a wall, while avoiding interference of the circular saw 101 with the wall.

In this cutting operation, the parallel ruler 303 moves in sliding contact with the side surface of the workpiece, so that the circular saw can be reliably guided in the direction of cutting the workpiece by the blade 113.

The circular saw 101 according to this embodiment is configured such that the blade 113 can project laterally outward from the left side 152 of the base 151 in order to allow the edge cutting operation. For this purpose, the base 151 has a relatively short width on the side of the blade 133. Therefore, when an ordinary cutting operation, rather than edge cutting operation, is performed, the sub-base 201 is attached to the side of the base 151 (see FIG. 1) and serves as an auxiliary element to make up for the short width of the base 151. The base 151 and the sub-base 201 work in cooperation to ensure a sufficient surface plate width on the both sides of the circular saw 101. Thus, the cutting operation by the blade 113 can be performed with stability.

In an ordinary cutting operation, two kinds of attachments, i.e. the sub-base 201 and the parallel ruler 301, can be attached to the base 151. FIGS. 4 to 7 show various manners of attachment of the sub-base 201 and/or the parallel ruler 301 in an ordinary cutting operation.

Figure 4:
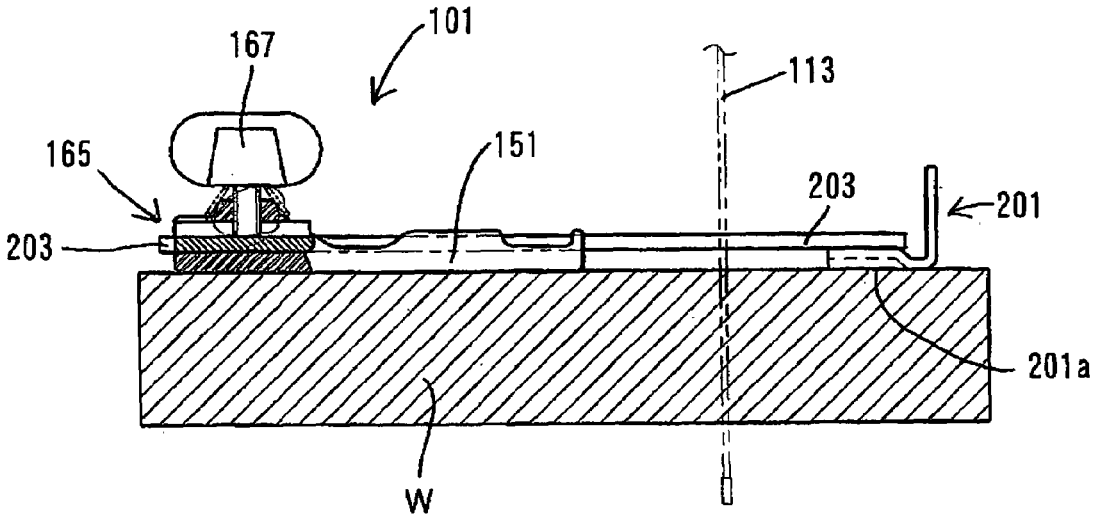
FIG. 4 is a partial view showing a first manner of attachment in which the sub-base is attached to the base.
Figure 5:
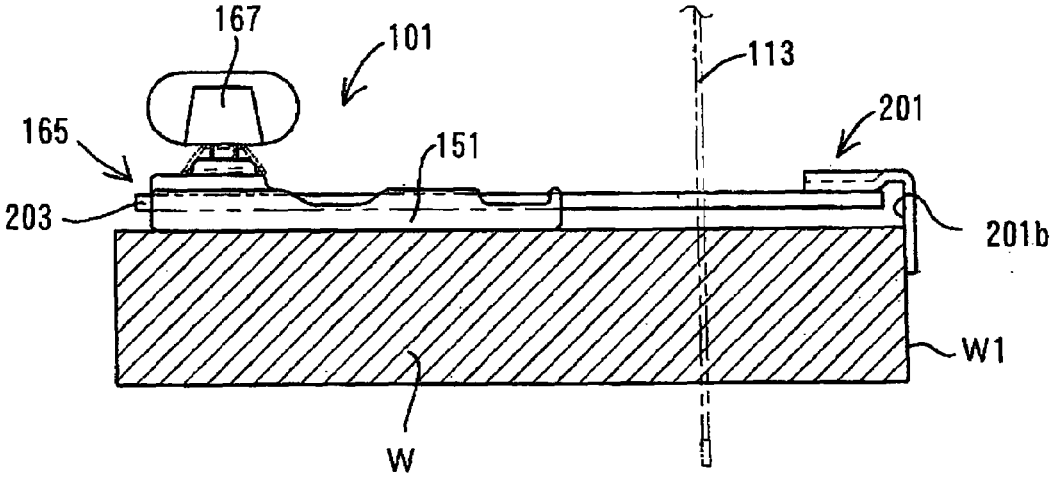
FIG. 5 is a partial view showing a second manner of attachment in which the sub-base is attached to the base.

FIGS. 4 and 5 show the state in which the sub-base 201 is attached and the parallel ruler 301 is not attached to the base 151. In the manner as shown in FIG. 4, the sub-base 201 is disposed a predetermined distance apart from the base 151 via the front pole 203 (and the rear pole 205 as shown in FIG. 1). A sliding contact portion 201*a* of the sub-base 201 is placed in sliding contact with the upper surface of the workpiece W in the cutting operation. Such arrangement of the sub-base 201 makes up for the short width of the base 151 on the side of the blade 113, thus ensuring the stability of the cutting operation of the circular saw on the workpiece.

In the manner as shown in FIG. 5, the sub-base 201 is attached upside down such that the inner surface of the upright portion 201*b* of the sub-base 201 is placed in sliding contact with the side surface W1 of the workpiece W in the cutting operation. Thus, the sub-base 201 can also serve as a guide in the cutting direction of the blade 113 in the cutting operation. Specifically, the sub-base 201, which is essentially provided in the circular saw 101 to make up for the short width of the base 151, is configured and arranged to perform multi-functions. Thus, the construction of the circular saw 101 can be rationalized.

In the manners as shown in FIGS. 4 and 5, the front pole 203 of the sub-base 201 may be clamped in the front clamping portion 165 by the clamping screw 167. At this time, as shown in FIGS. 2 and 3, the end 163*a* of the parallel ruler clamping hole 163 presses against the upper surface of the pole 203 of the sub-base 201, thereby effectively preventing the front pole 203 from lifting.

Figure 6:
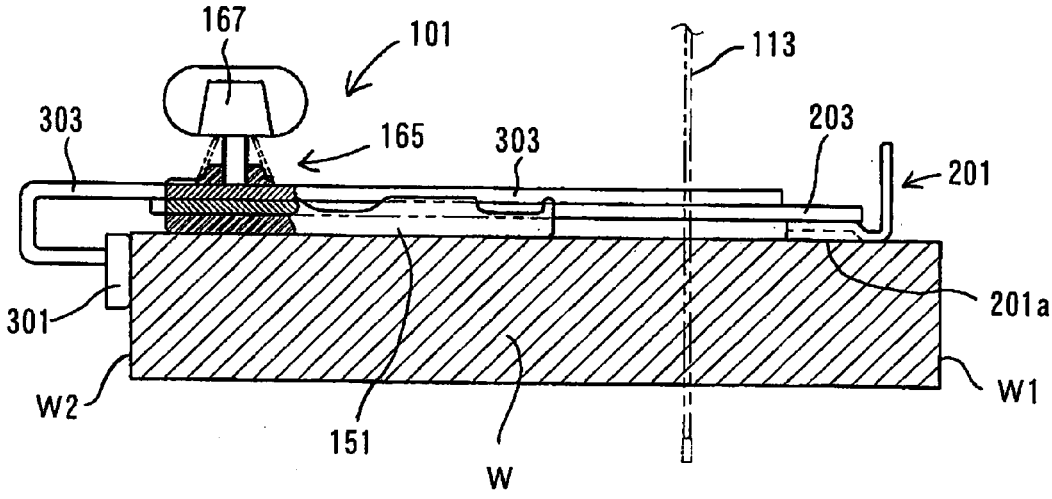
FIG. 6 is a partial view showing a third manner of attachment in which the sub-base and the parallel ruler are attached to the base on opposite side.
Figure 7:
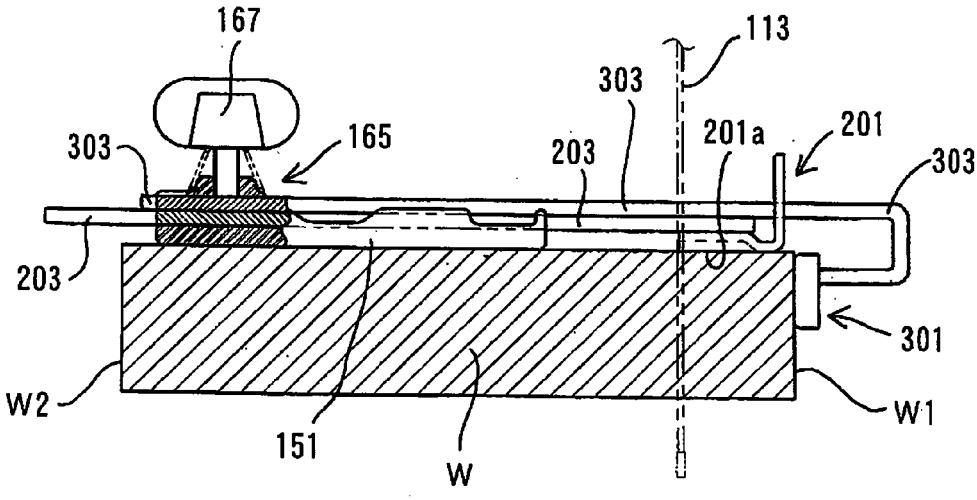
FIG. 7 is a partial view showing a fourth manner of attachment in which the sub-base and the parallel ruler are attached to the base on the same side.

FIGS. 6 and 7 show the state in which both the sub-base 201 and the parallel ruler 301 are attached to the base 151. In the manner as shown in FIG. 6, the sub-base 201 is disposed a predetermined distance apart from the base 151 via the front pole 203 (and the rear pole 205 shown in FIG. 1). A sliding contact portion 201*a* of the sub-base 201 is placed in sliding contact with the upper surface of the workpiece W in the cutting operation. Such arrangement of the sub-base 201 makes up for the short width of the base 151 on the side of the blade 113, thus ensuring the stability of the cutting operation of the circular saw on the workpiece. Further, the parallel ruler 301 is attached to the base 151 on the side opposite to the sub-base 201 via the pole 303. The parallel ruler 301 is placed in sliding contact with the side surface W2 of the workpiece W in the cutting operation. Thus, the parallel ruler 301 can serve as a guide in the cutting direction of the blade 113 in the cutting operation.

In the manner as shown in FIG. 7, the parallel ruler 301 is attached to the base 151 on the same side as the sub-base 201. The parallel ruler 301 is placed in sliding contact with the side surface W1 of the workpiece W in the cutting operation so as to serve as a guide in the cutting direction of the blade 113.

In the manners as shown in FIGS. 6 and 7, the front pole 203 and the pole 303 are removably clamped to the front clamping portion 165 by means of the one clamping screw 167 in order to attach the sub-base 201 and the parallel ruler 301 to the base 151.

Figure 8:
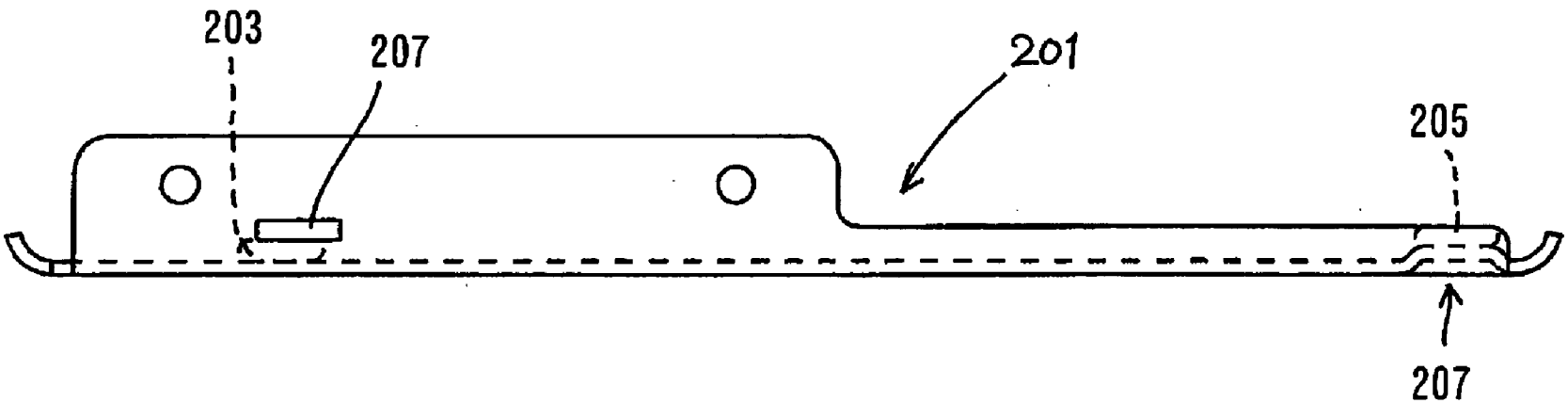
FIG. 8 is a side view of the sub-base.

FIG. 8 is a side view of the sub-base 201. With respect to the front pole 203 and the rear pole 205 for attaching the sub-base 201 to the base 151 (see FIG. 1), the sub-base 201 is configured such that the rear pole 205 is disposed in a higher position than the front pole 203. In other words, the front and rear sub-base clamping holes 161 and 169 are formed in a vertically displaced position from each other, so that the front and rear poles 203, 205 positioned at different levels from each other can be inserted through the holes 161, 169. Thus, as shown in FIGS. 4 and 5, the sub-base 201 can be attached to the base 151 on the side of the blade 113 (the left side 152 of the base 151 in FIG. 1) even in the upside-down state. On the other hand, the sub-base 201 cannot be attached to the base 151 on the other side (the right side 153 of the base 151 in FIG. 1), on which side the rear pole 205 in a higher position comes to the front side where the clamping hole 161 is formed in a lower position. With such construction, improper attachment of the sub-base 201 can be prevented. Further, an insertion hole 207 is formed in the sub-base 201 above the front pole 203, and the pole 303 of the parallel ruler 301 is inserted through the insertion hole.

Further, in this embodiment, the front and rear poles 203, 205 of the sub-base 201 and the pole 303 of the parallel ruler 301 have the same sectional shape. Therefore, it is not necessary to manufacture poles designed specifically for each attachment, so that the parts manufacturing costs can be reduced.

Figure 9:
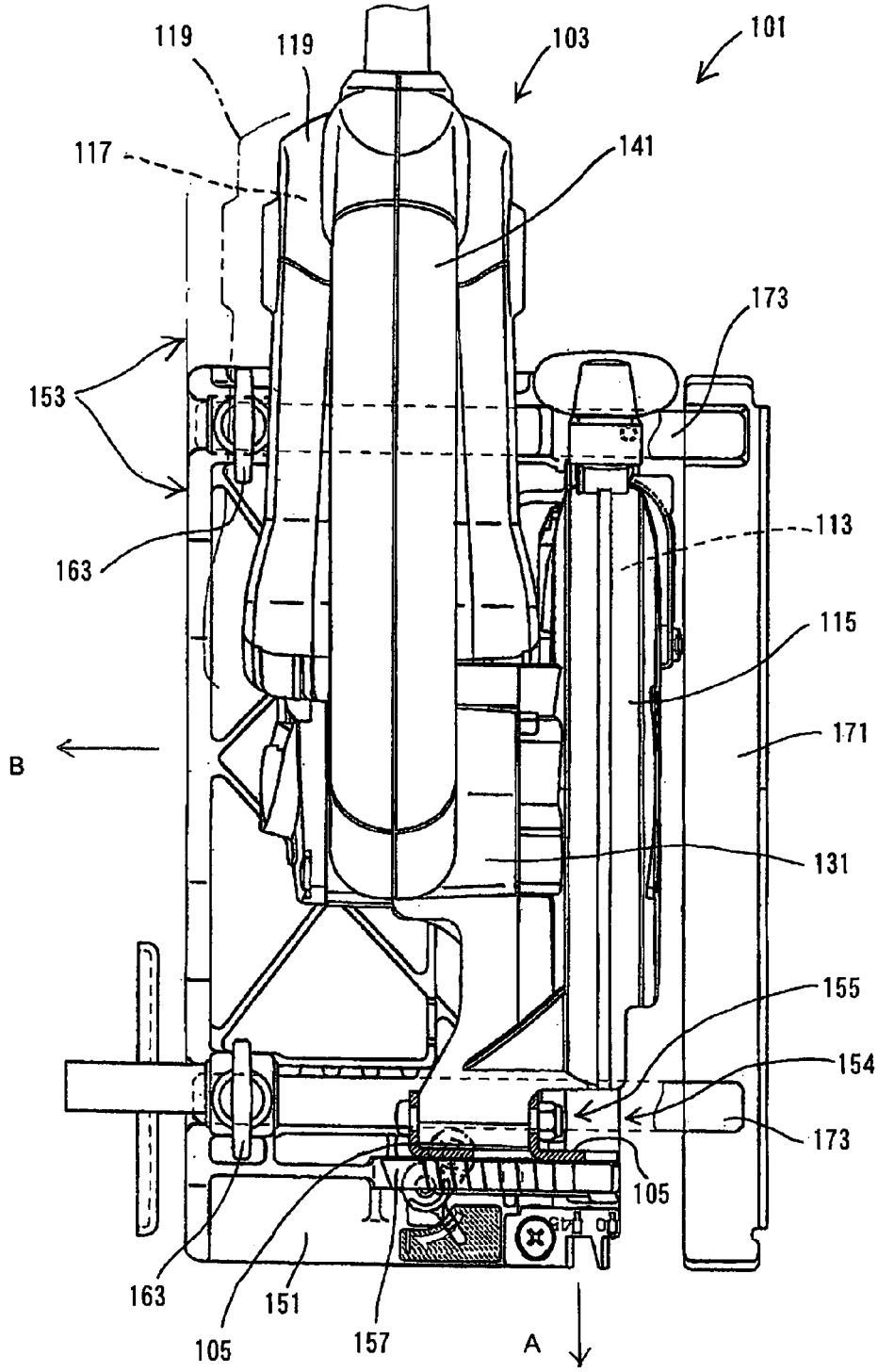
FIG. 9 is a plan view of a circular saw according to second representative embodiment of the invention.
Figure 10:
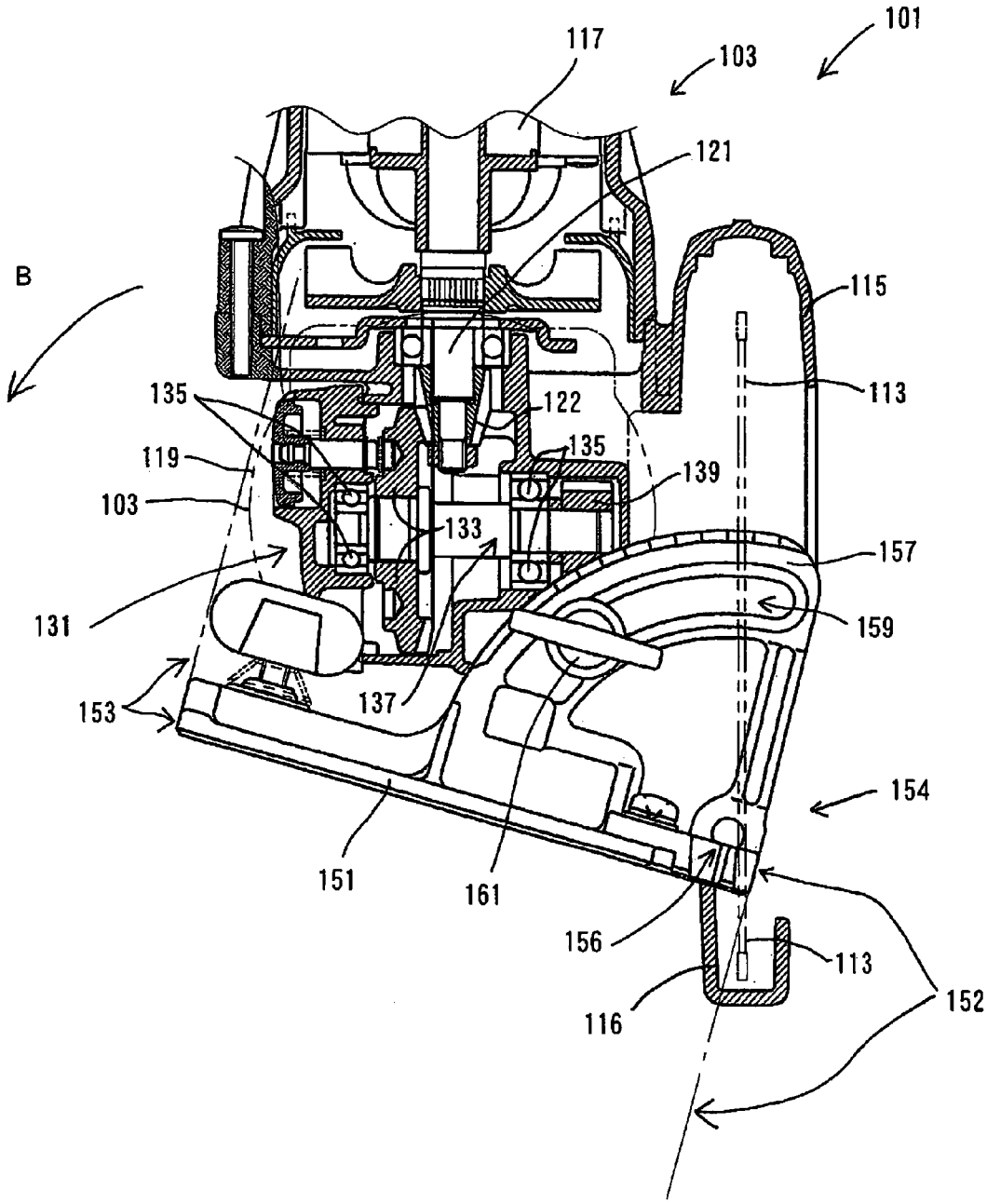
FIG. 10 is a front view, partially shown in section, of the circular saw according to second representative embodiment, showing the relationship between the driving motor and the base.

Further, the specific construction of the representative circular saw 101 to tilt the body 103 typically for the edge cutting operation is now described in detail in reference to FIGS. 9 and 10. As it is particularly shown in FIG. 10, the driving motor 117 has an output shaft 121 and a driving gear 122 is disposed in the end of the output shaft 121. Although the driving motor 117 is shown in the upright position perpendicular to the base 151 in FIG. 10 for the sake of convenience of explanation, the body 103 of the circular saw 101 can actually tilt within a predetermined range of 90° or less with respect to the base 151.

Driving gear 122 engages at a bevel with a driven gear 133 that is disposed within the gear housing 131. Driven gear 133 is disposed on one end of the blade driving shaft 137. A blade driving shaft 137 is rotatably journaled at two predetermined points in its axial direction by bearings 135, so that the driving shaft can rotate together with the driven gear 133 driven by the driving gear 122. A blade rotating shaft driving gear 139 is integrally formed with the blade driving shaft 137 in one end of the blade driving shaft 137 which is remote from the driven gear 133. Blade rotating shaft driving gear 139 transmits the driving force of the motor 117 to the blade shaft which is, although not shown, integrally formed with the blade in the center of rotation. The blade shaft is a feature that corresponds to the "rotational shaft of the blade" according to the present invention.

In this embodiment, the blade shaft and the blade driving shaft 137 are disposed parallel to each other. While, the blade driving shaft 137 and the output shaft 121 of the driving motor 117 are disposed perpendicularly to each other. Therefore, the axial direction of the output shaft 121 of the driving motor 117 is substantially perpendicular to the axial direction of the blade shaft. In other words, the axial direction of the output shaft 121 of the driving motor 117 is parallel to the rotational face of the blade 113. Therefore, in this embodiment, the driving motor 117 is disposed such that its longitudinal direction is parallel to the longitudinal direction A (see FIG. 9) of the circular saw 101. Specifically, the driving motor 117 is longitudinally disposed in parallel to the longitudinal direction A of the circular saw 101.

In FIGS. 9 and 10, the body 103 which has tilted toward a right base side plane 153 including the right side surface of the base 151 (leftward as viewed in FIGS. 9 and 10) is shown by dotted line, and the tilting direction of the body 103 is shown by an arrow B. As it is shown in FIG. 2, upon such tilting, the blade 113 projects outward (rightward as viewed in FIGS. 9 and 10) from a left base side plane 152 including the left side surface of the base 151, according to the tilting movement of the body 103 in the tilting direction B. Thus, the circular saw 101 is set in the edge cutting mode. In the edge cutting mode, the motor housing 119, which is a component of the body 103 situated in a laterally outermost position, stays inside of the right base side plane 153 (shown in the left side in FIG. 10) even when the body 103 tilts in the lateral direction with respect to the base 151 to the maximum extent. In other words, even when the body 103 tilts to the maximum extent in the edge cutting mode, the body 103 is held in a state in which it is prevented from projecting laterally outward from the base 151.

The body 103 which is not tilted in the lateral direction with respect to the base 151 but is in an upright position is shown by solid line in FIG. 9.

The representative circular saw 101 is configured such that even in the edge cutting mode, the side edge of the motor housing 119 that houses the longitudinally disposed driving motor 117 does not project laterally outward from the right side 153 of the base 151. Thus, the space can be saved which may be required when tilting the body 103 in the lateral direction with respect to the base 151. As a result, the possibility that the body 103 may accidentally hit any obstacle so that the cutting operation is interfered with, can be minimized not only on the side from which the blade 113 projects but on the other side to which the body 103 tilt.

DESCRIPTION OF NUMERALS

101 circular saw
103 body
113 blade
115 blade case
117 driving motor
119 motor housing
131 gear housing
141 handgrip
151 base
152, 153 side of the base
154 connection
155 bolt (center of pivotal movement)
157 angle plate
161 front sub-base clamping hole
163 parallel ruler clamping hole

163*a* end of the parallel ruler clamping hole
167 clamping screw
169 rear sub-base clamping hole
171 rear clamping portion
173 clamping screw
201 sub-base
201*a* guide (sliding contact portion)
203 front pole
205 rear pole
207 raised bottom portion
209 insertion hole
301 parallel ruler
303 pole
A longitudinal direction of the circular saw (cutting direction)
W workpiece
W1, W2 side surface of the workpiece

The invention claimed is:

1. A cutting tool comprising:

a body having a blade that cuts a workpiece by moving forward in a predetermined cutting direction while being rotationally driven, a base that is connected to the body, the base being placed in contact with the upper surface of the workpiece, wherein the body is tilted in a pivotal movement about an axis which is substantially parallel to the cutting direction, so that a cutting operation is performed with the blade projecting laterally outward from a side of the base, a sub-base that is removably attached to the base on the side from which the blade projects and a parallel ruler that is removably attached to the base on the side on which the sub-base is attached or on the opposite side of the base, together with the sub-base, wherein the base has a sub-base clamping hole and a parallel ruler clamping hole that is disposed on or under the sub-base clamping hole, a clamping portion of the sub-base being removably inserted through the sub-base clamping hole, and a clamping portion of the parallel ruler being removably inserted through the parallel ruler clamping hole, and the sub-base clamping hole and the parallel ruler clamping hole are arranged and adapted such that at least either a front or rear end of the upper one of the clamping holes is positioned between both ends of the lower clamping hole.

2. The cutting tool as defined in claim 1, wherein the sub-base clamping hole has substantially the same width in the longitudinal direction of the base as the parallel ruler clamping hole, and the clamping holes are formed in a position displaced from each other in the longitudinal direction of the base.

3. The cutting tool as defined in claim 1, wherein the sub-base and the parallel ruler are inserted through the respective clamping holes and removably clamped to the base at the same time by one clamping device.

4. The cutting tool as defined in claim 1, wherein the base has a front sub-base clamping hole and a rear sub-bass clamping hole, through which holes respective clamping portions of the sub-base are removably inserted, the front and rear sub-base clamping holes being formed in a vertically displaced position from each other.

* * * * *